United States Patent [19]

Lowe

[11] Patent Number: 4,838,096

[45] Date of Patent: Jun. 13, 1989

[54] BUNG OPENING LOCATOR AND METHOD

[76] Inventor: Terry B. Lowe, 133 Pagosa Way, Fremont, Calif. 94539

[21] Appl. No.: 191,281

[22] Filed: May 6, 1988

[51] Int. Cl.[4] ..... B67L 3/02

[52] U.S. Cl. ..... 73/865.8; 141/94

[58] Field of Search ..... 73/865.8; 141/94, 165, 141/312; 414/757; 198/379

[56] References Cited

U.S. PATENT DOCUMENTS

| | | | |
|---|---|---|---|
| 3,993,199 | 11/1976 | Jorgensen et al. | 198/379 |
| 4,494,583 | 1/1985 | Reeves, Jr. et al. | 141/94 |
| 4,520,853 | 6/1985 | Niese et al. | 141/94 |

*Primary Examiner*—Stewart J. Levy

*Assistant Examiner*—Robert R. Raevis

*Attorney, Agent, or Firm*—Flehr, Hohbach, Test, Albritton & Herbert

[57] ABSTRACT

Apparatus and method for locating the bung opening of a container such as a drum. The container is rotated about its axis to move the bung opening along a generally circular path, and a locator pin with a pivotally mounted follower arm is positioned in the path of the opening so that the follower arm will travel along the wall of the container, then pivot and enter the opening when the pin is aligned with the opening. The pivoting of the follower arm is detected by an interruption of air flow through a discharge opening which is obstructed when the arm is in position to enter the opening.

17 Claims, 2 Drawing Sheets

BUNG OPENING LOCATOR AND METHOD

BACKGROUND

This invention pertains generally to the filling of drums and other containers, and more particularly to apparatus and a method for locating the bung opening of a container.

Drums and other containers have a filler opening, commonly known as a bung opening, through which a liquid is introduced into and removed from the container. Such containers are commonly filled by machines having lances which are extended into the containers through the bung openings during a filling operation. In order for the lance to pass through the opening, the container must be accurately positioned with the opening in alignment with the lance.

U.S. Pat. No. 3,993,199 describes apparatus for finding a filler opening and then using the opening to rotate the container to align the opening with a fill valve or lance. In this apparatus, the container is rotated, and a locator cone with a guide wheel rolls along the container and drops into the opening when the opening is aligned with the cone. Once the cone has dropped into the opening, an arm on which the cone is mounted is actuated to bring the opening into alignment with the fill valve or lance.

U.S. Pat. No. 4,494,583 describes a bung alignment mechanism which employs an infrared sensor to align the filling lance and the bung opening.

Each of these devices has certain limitations and disadvantages such as high cost and undue complexity.

OBJECTS AND SUMMARY

It is in general an object of the invention to provide a new and improved bung opening locator and method. Another object of the invention is to provide a bung opening locator and method of the above character which overcome the limitations and disadvantages of devices heretofore provided for this purpose.

These and other objects are achieved in accordance with the invention by rotating a container about its axis to move the bung opening along a generally circular path, positioning a locator pin with a pivotally mounted follower arm in the path of the opening so that the follower arm will travel along the wall of the container, then pivot and enter the opening when the pin is aligned with the opening, and advancing the pin into the opening in response to the pivoting of the follower arm. The pivoting of the follower arm is detected by an interruption of air flow through a discharge opening which is obstructed when the arm is in position to enter the opening.

DETAILED DESCRIPTION

Figure 1:
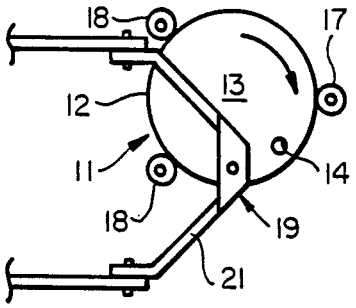
FIG. 1 is a top plan view of one embodiment of apparatus for locating the bung opening of a container in accordance with the invention.
Figure 3:
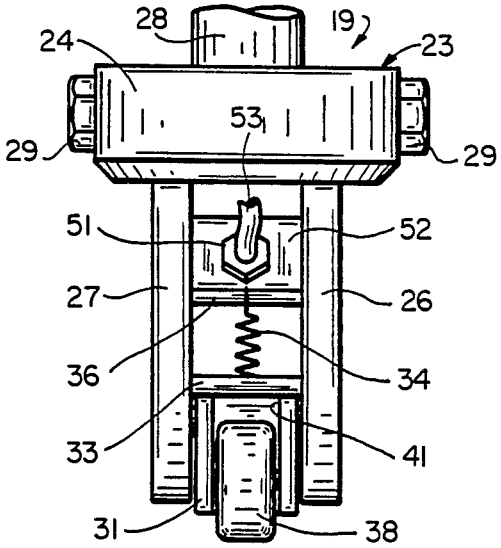
FIG. 3 is an end elevational view of the portion of the apparatus shown in FIG. 2.
Figure 5:
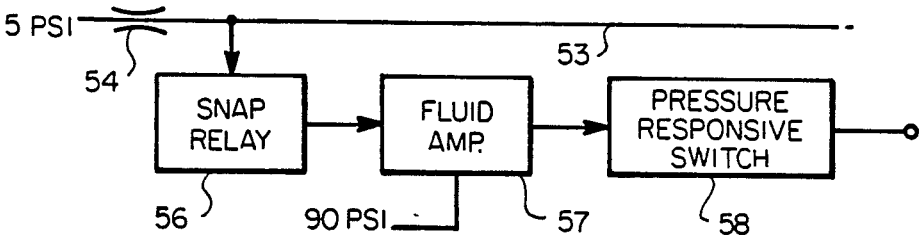
FIG. 5 is a block diagram of a sensing circuit employed in the embodiment of FIG. 1.

In the drawings, the invention is illustrated in connection with a cylindrical container, or drum, 11 which has a side wall 12 and a generally planar top wall 13, with a bung open 14 in the top wall. The bung opening is surrounded by a raised lip or flange 16 which projects a short distance above the top wall of the container.

The apparatus includes a drive roller 17 and a pair of idler rollers 18 which engage the side wall of the container and rotate the container about its axis, with bung opening 14 travelling along a circular path as the container is rotated. A sensing head 19 is mounted in a fixed position along the circular path for locating the opening in the rotating container. The sensing head is mounted on a swinging arm 21 which permits the head to move up and down relatively to the container. The sensing head is positioned in alignment with a filling lance (not shown), and once the opening has been aligned with the lance, the sensing head is swung back out of the way so the lance can enter the opening.

The sensing head includes a locator pin 23 which has a generally circular base 24 with a pair of spaced apart, parallel depending legs 26, 27. These legs are tapered and adapted to be received in the bung opening of a container. The locator pin is mounted in a fixed position on a shaft 28 which is affixed to swinging arm 21. The pin is secured to the shaft by a pair of bolts 29 which are threaded into the shaft.

Figure 2:
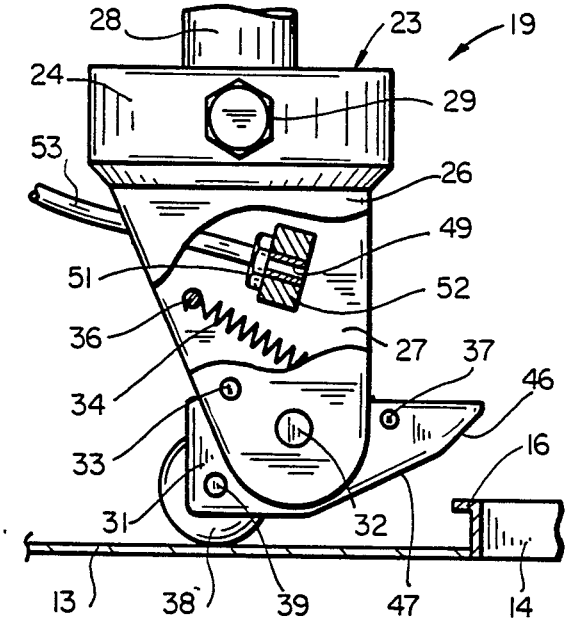
FIG. 2 is a side elevational view, partly broken away, of a portion of the apparatus in the embodiment of FIG. 1.
Figure 4:
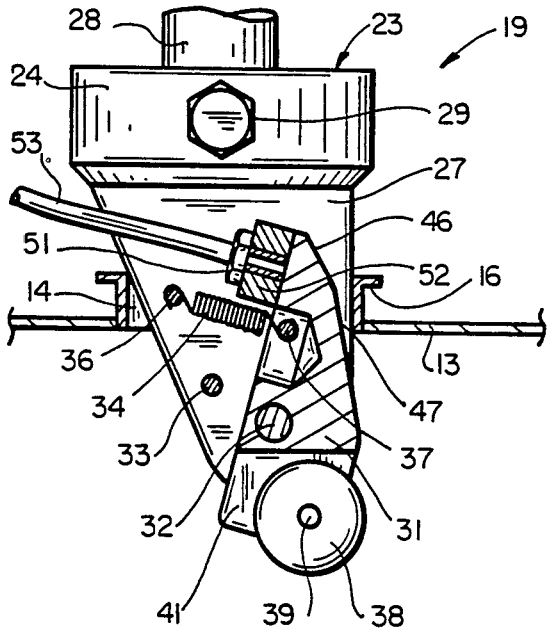
FIG. 4 is a vertical sectional view of the portion of apparatus shown in FIG. 2, with the apparatus in a different operative position.

A follower arm 31 is mounted on a pin 32 between the lower portions of legs 26, 27 for pivotal movement between a first position in which the arm is generally perpendicular to the longitudinal axis of the locator pin and a second position in which the arm is aligned with the longitudinal axis of the pin. These two positions are illustrated in FIGS. 2 and 4, respectively. A cross pin 33 extends between the legs of the locator pin to limit the movement of the follower arm toward the perpendicular position, and a coil spring 34 connected between cross pins 36, 37 on the locator pin and the follower arm, respectively, yieldably urges the arm toward the aligned position. A roller 38 is rotatively mounted on an axle 39 in a slot 41 at the rear of the follower for rolling engagement with the upper wall of the container. If desired, a pad can be provided at the rear of the follower arm for contact with the container wall instead of the roller.

The under side of the front portion of follower arm 31 is bevelled to form a ramp for guiding the arm over the raised lip surrounding the bung opening of a container. In the embodiment illustrated, the ramp has a leading section 46 and a main section 47, each of which is generally planar. The leading section is inclined at a steeper angle than the main section to facilitate initial deflection of the arm by taller lips.

Means is provided for sensing when the follower arm is aligned with the locator pin, i.e. when it has dropped into the bung opening. This means includes an air discharge opening 49 in a fitting 51 mounted on a cross member 52 between the legs of the locator pin. Air is supplied to the discharge opening through an air line 53 which is connected to fitting 51. The discharge opening is positioned in such manner that it is blocked by the follower arm to obstruct the flow of air when the arm is aligned with the locator pin. When the arm is in its other position, the flow of air through the discharge opening is not obstructed.

Air is bled into line 53 from a low pressure source (e.g., 5 psi) through a needle valve 54. The pressure in the line is monitored by a snap relay 56 which can detect a very small change in the pressure in the line (e.g., 0.1 inch water, or 1/280 psi). The fluid output signal from the snap relay is applied to a fluid amplifier 57, and the amplified fluid signal is converted to an electrical signal by a pressure responsive switch 58. This signal can be utilized, for example, to de-energize the motor which drives roller 17 to rotate the drum.

Operation and use of the bung opening locator, and therein the method of the invention, are as follows. A drum is positioned between rollers 17 and 18, and swinging arm 21 is lowered so that roller 38 engages the top wall of the drum, with follower arm 31 in its horizontal position. With the follower in this position, air discharge opening 49 is unobstructed, and the low pressure air passes freely through the line and the discharge opening. As the drum is rotated, roller 38 rolls along the top wall of the drum until the lip surrounding the bung opening contacts the ramp on the under side of the arm. As the drum continues to rotate, the lip lifts the arm, the pin and the roller, and when the lip moves past the roller, the arm pivots in a counterclockwise direction, as viewed in FIG. 2. The arm rotates until it is aligned with the locator pin, at which point the arm and the pin drop into the bung opening.

When the follower arm is aligned with the locator pin, it obstructs the discharge of air through opening 49, thereby increasing the pressure in air line 53. This increase is detected by snap relay 56, and the drive roller is deactuated in response to the resulting output signal from pressure responsive switch 58. Spring 34 holds the arm against the block 52, and the discharge opening remains obstructed until the locator pin is withdrawn from the bung opening and the follower is returned to its horizontal position. Once the bung opening has thus been positioned, the swing arm can be lifted and the filling lance can be lowered into the drum.

It is apparent from the foregoing that a new and improved bung opening locator and method have been provided. While only certain presently preferred embodiments have been described in detail, as will be apparent to those familiar with the art, certain changes and modifications can be made without departing from the scope of the invention as defined by the following claims.

I claim:

1. In apparatus for locating the bung opening of a liquid container: a locator pin adapted to be received in the opening, a follower arm pivotally mounted on the pin for movement between a first position in which the arm is generally perpendicular to the longitudinal axis of the pin and a second position in which the arm is aligned with the longitudinal axis of the pin and can be received in the opening with the pin, and sensor means for determining when the arm is in the second position.

2. The apparatus of claim 1 including means yieldably urging the follower arm toward the second position.

3. The apparatus of claim 1 wherein the sensor means comprises a gas discharge opening which is unobstructed when the follower arm is in the first position and is obstructed when the arm is in the second position, means for passing a gas through the discharge opening, and means responsive to the pressure of the gas for determining when the arm is in the second position.

4. The apparatus of claim 1 wherein the follower arm has a ramp toward one end thereof for engaging a lip surrounding the bung opening and guiding the arm over the lip so that the arm and the pin can drop into the opening.

5. The apparatus of claim 1 wherein the follower arm includes a roller for rolling engagement with a wall of the container in which the opening is located.

6. In apparatus for locating a bung opening in the upper wall of a cylindrical container: means for rotating the container about its axis so that the opening travels along a circular path, a locator pin mounted in the path of the opening and adapted to be received in the opening when aligned therewith, a follower arm pivotally mounted on the pin for movement between a first position in which the arm is generally perpendicular to the longitudinal axis of the pin and a second position in which the arm is aligned with the longitudinal axis of the pin and can be received in the opening with the pin, and sensor means for determining when the arm is in the second position.

7. The apparatus of claim 6 including means yieldably urging the follower arm toward the second position.

8. The apparatus of claim 6 wherein the sensor means comprises an air bleed opening which is unobstructed when the follower arm is in the first position and is obstructed by the arm when it is in the second position, means for passing air through the air bleed opening, and means responsive to the pressure of the air for determining when the arm is in the second position.

9. The apparatus of claim 6 wherein the follower arm has a ramp toward one end thereof for engaging a lip surrounding the bung opening and guiding the arm over the lip so that the arm and the pin can drop into the opening.

10. The apparatus of claim 6 wherein the follower arm includes a roller engageable with the upper wall of the container.

11. In apparatus for locating a bung opening in the wall of a container: a locator pin adapted to be received in the opening, a follower mounted on the locator pin for engagement with the wall of the container and adapted for movement into the opening when the pin is aligned axially with the opening, a gas discharge opening which is unobstructed when the follower is in engagement with the wall of the container and is obstructed when the follower is in the bung opening, means for passing a gas through the discharge opening, and means for monitoring the pressure of the gas to determine when the follower is in the bung opening.

12. The apparatus of claim 11 wherein the follower comprises an arm pivotally mounted on the locator pin for movement between a first position in which the arm is generally perpendicular to the pin and a second position in which the arm is aligned with the pin.

13. The apparatus of claim 12 wherein the follower includes a roller mounted on the arm for rolling engagement with the wall of the container.

14. The apparatus of claim 11 wherein the follower includes a ramp engageable with a lip surrounding the bung opening for lifting the follower over the lip.

15. In a method of locating a bung opening in the wall of a cylindrical container, the steps of: rotating the container about its axis to move the opening along a generally circular path, positioning a locator pin with a follower arm pivotally mounted thereon in the path of the opening so that the follower arm will pivot and enter the opening when the pin is aligned axially with the opening, and advancing the pin into the opening in response to the pivoting of the follower arm.

16. The method of claim 15 wherein the follower arm is yieldably urged toward the wall of the container.

17. The method of claim 15 including the steps of flowing a gas through a discharge opening in the locator pin, obstructing the discharge opening in response to the pivoting of the follower arm, and monitoring the gas flow to determine the position of the follower arm.

* * * * *